US005945873A

United States Patent [19]

Antone et al.

[11] Patent Number: 5,945,873

[45] Date of Patent: Aug. 31, 1999

[54] CURRENT MIRROR CIRCUIT WITH IMPROVED CORRECTION CIRCUITRY

[75] Inventors: James A. Antone, Edwards; William J. Love, Dunlap, both of Ill.

[73] Assignee: Caterpillar Inc., Peoria, Ill.

[21] Appl. No.: 08/990,504

[22] Filed: Dec. 15, 1997

[51] Int. Cl.[6] ..... G05F 1/10

[52] U.S. Cl. ..... 327/541; 327/540; 327/543; 323/313; 323/315

[58] Field of Search ..... 327/538, 540, 327/541, 543; 323/313, 315

[56] References Cited

U.S. PATENT DOCUMENTS

| | | | |
|---|---|---|---|
| H743 | 2/1990 | Bismark | 323/313 |
| 4,081,696 | 3/1978 | Oda et al. | 327/349 |
| 4,317,054 | 2/1982 | Caruso et al. . | |
| 4,495,425 | 1/1985 | McKenzie | 327/541 |
| 4,567,426 | 1/1986 | Plassche et al. | 323/315 |
| 4,570,115 | 2/1986 | Misawa et al. . | |
| 4,683,414 | 7/1987 | Moore | 320/13 |
| 4,703,249 | 10/1987 | De La Plaza et al. . | |
| 4,803,381 | 2/1989 | Gornati et al. | 327/132 |
| 4,897,595 | 1/1990 | Holle . | |
| 4,912,347 | 3/1990 | Morris . | |
| 4,990,845 | 2/1991 | Gord . | |
| 5,451,860 | 9/1995 | Khayat | 323/314 |
| 5,500,615 | 3/1996 | Barter | 327/111 |
| 5,619,163 | 4/1997 | Koo . | |
| 5,739,682 | 4/1998 | Kay | 323/315 |

*Primary Examiner*—Terry D. Cunningham
*Attorney, Agent, or Firm*—Michael J. Nieberding

[57] ABSTRACT

A current mirror circuit is provided including a first and second transistors of a first conductivity type, the first transistor having a base connected to a base of the second transistor forming a base junction. A third transistor which is of a second conductivity type is connected in series with the first transistor and a collector of the third transistor is connected to the base junction of the first and second transistors. A fourth transistor which is of the second conductivity type is connected in series with the second transistor and has a base connected to a base of the third transistor forming a base junction. A collector of the second transistor is connected to the base junction of the third and fourth transistors. A first resistor is connected between an emitter of the third transistor and ground and a second resistor is connected between an emitter of the fourth transistor and ground. The circuit provides current matching over the first and second resistors where such resistors have about the same resistance values.

4 Claims, 3 Drawing Sheets

( PRIOR ART )

CURRENT MIRROR CIRCUIT WITH IMPROVED CORRECTION CIRCUITRY

TECHNICAL FIELD

This invention relates generally to current mirrors, and more particularly, to a current mirror circuit for positioning between an electrical energy source and a load so as to produce an output voltage proportional to a load current.

BACKGROUND ART

The present invention is an improvement to the current mirror correction circuitry described in patent application Ser. No. 08/638,419, filed Apr. 26, 1996, which application is assigned to the assignee of the present invention. As shown in FIG. 1, such circuit includes first and second pnp transistors 10 and 12 having connected bases. A resistor 14 is connected to the emitter of transistor 10 and a resistor 16 is connected to the emitter of transistor 12. The two transistors are configured to provide voltage tracking across the resistors 14 and 16. Such a current mirror topology has some inherent inaccuracies in that the base-emitter voltage of transistor 12 is not always identical to the base-emitter voltage of transistor 10. For example, for large values of $V_s$ and small values of resistor 14 the base-emitter voltage of transistor 10 will be nearly constant but the base-emitter voltage of transistor 12 will vary with changes in the load current $I_1$ and thus the current through resistor 16. Therefore, rather than connecting the collectors of transistors 10 and 12 directly to respective resistors, the circuit includes an npn transistor 18 connected in series with the transistor 10 and an op-amp 20 having its input terminals arranged to provide current matching across a pair of like value resistors 22 and 24 in order to provide an output voltage $V_1$ across resistor 24 which is proportional to the load current $I_1$.

However, such circuit is relatively complex and op-amps are relatively expensive. It would therefore be desirable to provide a circuit which enables current matching across a pair of like value resistors with a reduced number of parts so as to reduce costs. There also exists a need to accurately measure rapidly changing high currents on the high side of a load being driven by a high voltage. It would therefore be desirable to provide a circuit which responds faster to changes in the load current.

Accordingly, the present invention is directed to overcoming one or more of the problems as set forth above.

DISCLOSURE OF THE INVENTION

In one embodiment of the present invention a current mirror circuit is provided including a first and second transistors of a first conductivity type, the first transistor having a base connected to a base of the second transistor forming a base junction. A third transistor which is of a second conductivity type is connected in series with the first transistor and a collector of the third transistor is connected to the base junction of the first and second transistors. A fourth transistor which is of the second conductivity type is connected in series with the second transistor and has a base connected to a base of the third transistor forming a base junction. A collector of the second transistor is connected to the base junction of the third and fourth transistors. A first resistor is connected between an emitter of the third transistor and ground and a second resistor is connected between an emitter of the fourth transistor and ground. The circuit provides current matching over the first and second resistors where such resistors have about the same resistance values.

BEST MODE FOR CARRYING OUT THE INVENTION

Figure 1:
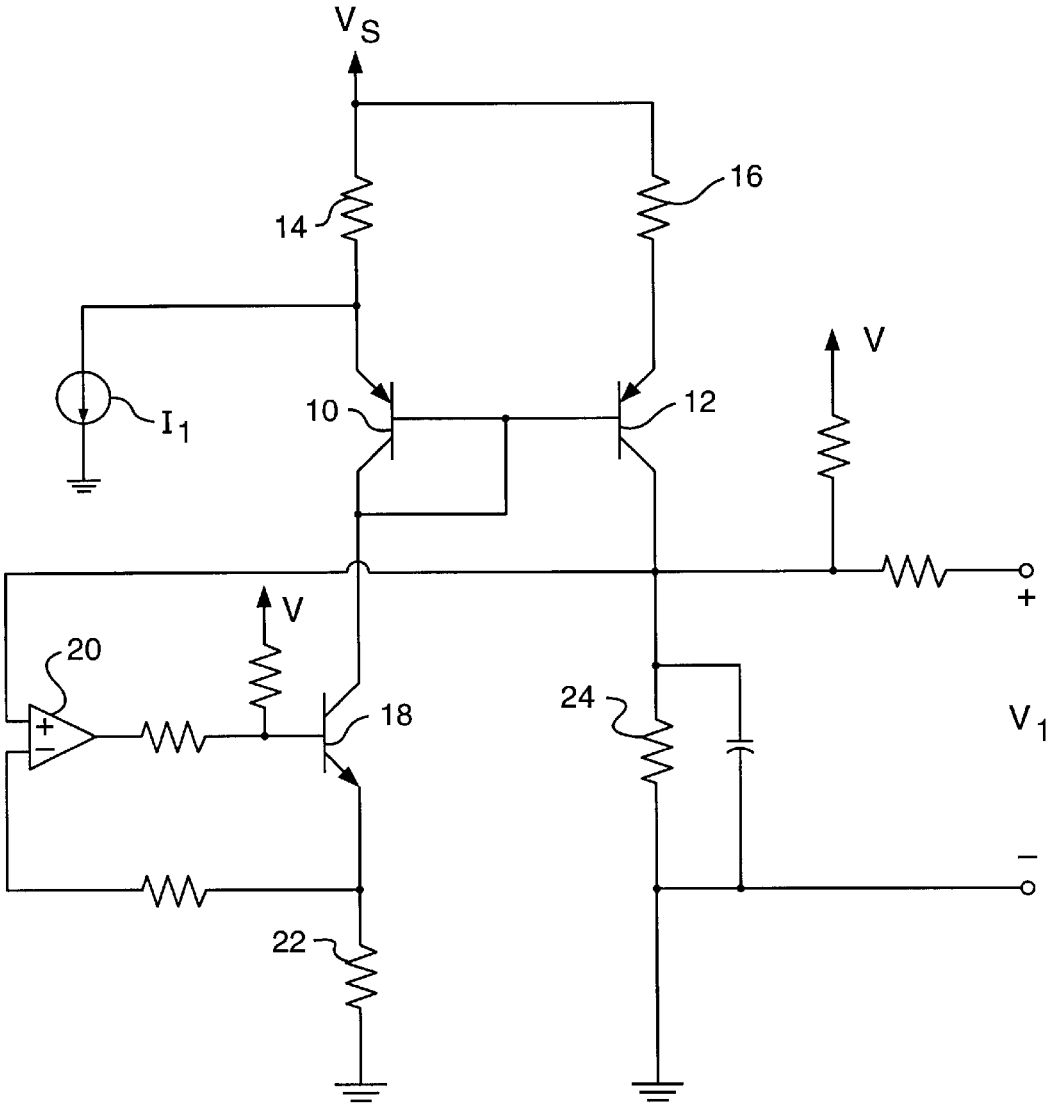
FIG. 1 illustrates a circuit which includes a transistor and op-amp arrangement to force current tracking through a pair of resistors.

Referring to the drawings, as noted above with respect to FIG. 1, voltage tracking across resistors 14 and 16 is forced by the common base transistors 10 and 12. The transistor 18 and op amp 20 combination is utilized to force current tracking through resistors 22 and 24.

Figure 2:
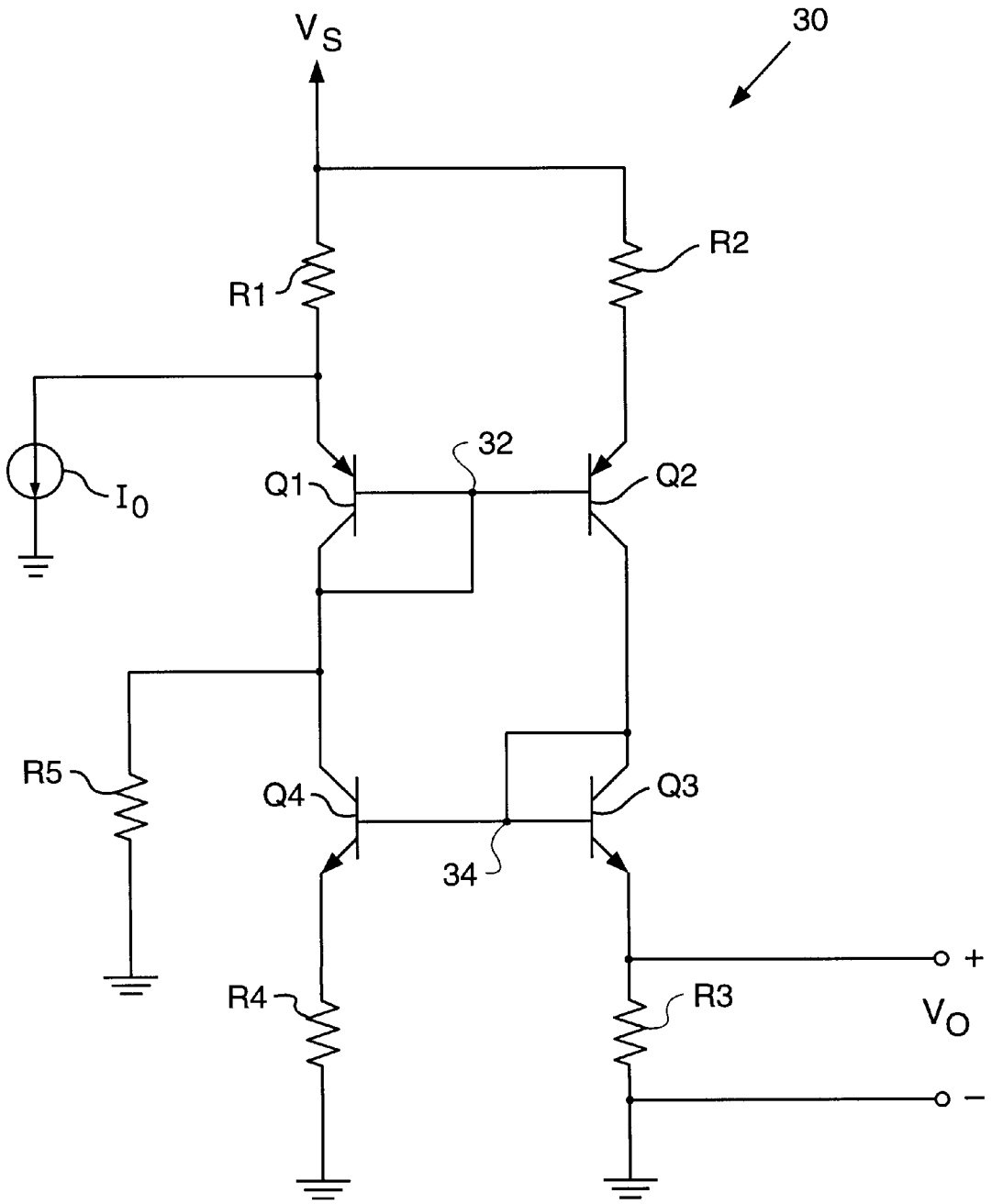
FIG. 2 illustrates a current mirror circuit in accordance with the present invention.

FIG. 2 illustrates a mirror circuit 30 in accordance with the present invention which also incorporates forced voltage tracking across a pair of resistors and forced current tracking through a pair of resistors. In particular, pnp transistors $Q_1$ and $Q_2$ include bases which are connected, forming base junction 32. A resistor $R_1$, preferably a low value sense resistor, includes a first side connected to electrical energy source $V_s$ and a second side connected to an emitter of transistor $Q_1$. A resistor $R_2$ includes a first side connected to electrical energy source $V_s$ and a second side connected to an emitter of transistor $Q_2$. Due to the base junction 32 formed between transistors $Q_1$ and $Q_2$, voltage tracking across resistors $R_1$ and $R_2$ is forced. That is, because the base-emitter voltage of both transistors will ideally be about the same, the voltage drop across resistors $R_1$ and $R_2$ will also be about the same.

As noted above however, where the resistance value of resistor $R_1$ is small, and the voltage $V_s$ is large, the base-emitter voltage of transistor $Q_1$ will be nearly constant because the emitter current of transistor $Q_1$ will be nearly constant. Due to variations which could occur in the base-emitter voltage of transistor $Q_2$ as the emitter current of transistor $Q_2$ changes, it is desirable to attempt to match the emitter current of transistor $Q_1$ to the emitter current of transistor $Q_2$. Transistors $Q_3$ and $Q_4$ are utilized to achieve this by forcing a matching current across resistors $R_3$ and $R_4$.

In particular, npn transistor $Q_4$ is connected in series with pnp transistor $Q_1$ and has a collector connected to the base junction 32 of transistors $Q_1$ and $Q_2$. The npn transistor $Q_3$ is connected in series with pnp transistor $Q_2$ and has a base connected to the base of transistor $Q_4$, forming base junction 34. The voltage drop from base junction 34 through resistor $R_3$ should be the same as the voltage drop from base junction 34 through resistor $R_4$. Because the base-emitter voltage of transistors $Q_3$ and $Q_4$ should be about the same, if resistors $R_3$ and $R_4$ are selected having about the same resistance values then the currents through each resistor $R_3$ and $R_4$ should be matched. Because the current through transistor $Q_4$ and resistor $R_4$ comes from transistor $Q_1$ and the current through transistor $Q_3$ and resistor $R_3$ comes from transistor $Q_2$, by matching the currents through resistors $R_4$ and $R_3$ the emitter currents of transistors $Q_1$ and $Q_2$ should also be closely matched, assuming that the base currents are negligible. This circuit configuration therefore provides an output voltage $V_o$ which is proportional to the load current $I_o$.

The circuit 30 is also more quickly responsive to changes in the load current than the circuit of FIG. 1 because no op amp is utilized. Further, as seen by comparing the two circuits, less components are required for the circuit 30.

In order to assure proper start-up current for circuit 30 a high value resistor $R_5$ is connected to base junction 32 in order to provide a small bias current through all four transistors even when the load current is zero and, therefore, the output voltage $V_o$ never reaches zero even when the load current reaches zero. However, in some applications it is not necessary to accurately measure the load current at such low values.

INDUSTRIAL APPLICABILITY

The current mirror circuit 30 may advantageously be positioned between an electrical energy source $V_s$ and a load such as a fuel injector, the load path being connected between resistor $R_1$ and transistor $Q_1$ and having a representative load current $I_o$. The circuit 30 will provide an output voltage $V_o$ which is proportional to the load current $I_o$, In particular, except for at very low load currents as mentioned above, the output voltage $V_o$ will be $$V_o=(I_oR_1R_3)/R_2$$

The output voltage $V_o$ can be referenced within an engine control system to monitor the current through an injector in order to achieve a desired injection profile. Thus, circuit 30 can be used in different engine applications where different fuel injection profiles are desired.

Figure 3A:
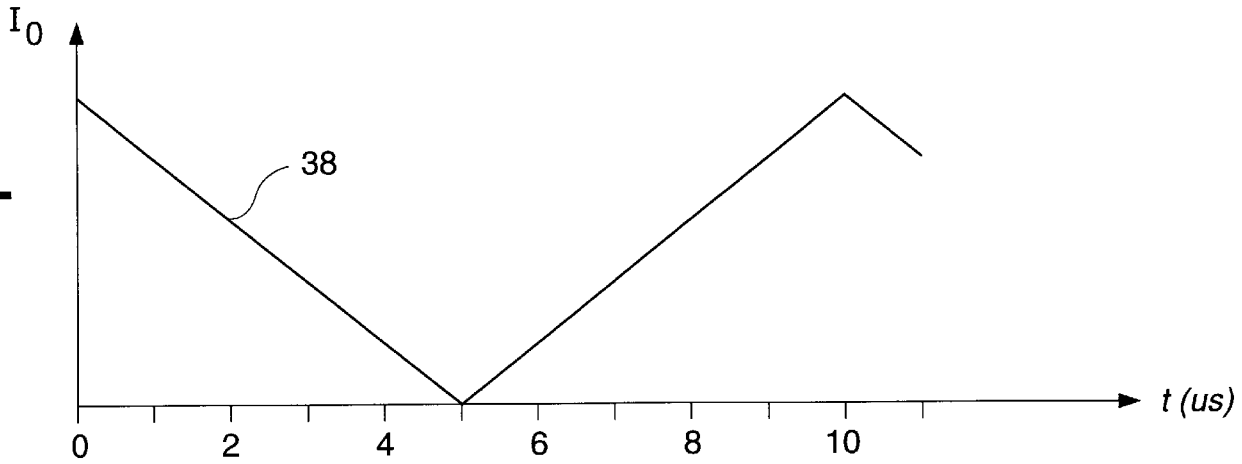
FIGS. 3A and 3B illustrate representative graphs of load current and output voltage for the current mirror circuit of FIG. 2
Figure 3B:
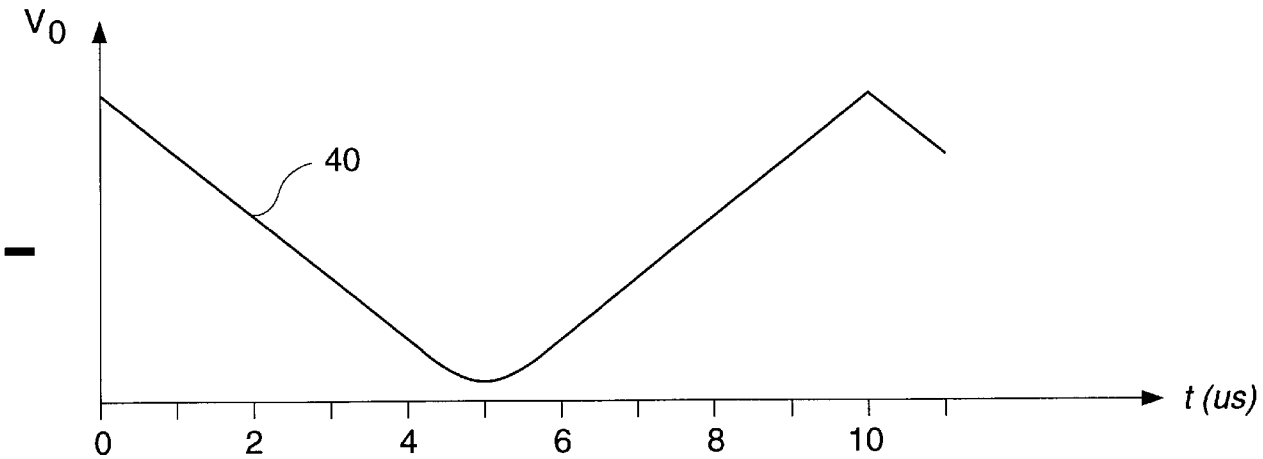

The typical time period of a single injection is relatively short and it is therefore advantageous that the output voltage $V_o$ is quickly responsive to changes in the load current $I_o$. In this regard, referring to FIGS. 3A and 3B, a representative graph of a load current or input current 38 verses time and a representative graph of a corresponding output voltage 40 verses time are shown. The time scales for the two graphs are the same and the following component values are assumed by way of example only, $R_1$=0.025 ohms, $R_2$=499 ohms, $R_3$=$R_4$=2,000 ohms, and $R_5$=100,000 ohms. Such graphs illustrate that the output voltage responsively varies with the load current. With specific reference to output voltage 40, it is seen that as the load current reaches zero the output voltage will not reach zero due to the use of biasing resistor $R_5$. However, when the load current exceeds a relatively low level the output voltage closely follows such current in a very linearly proportional manner.

Other aspects, objects and advantages of the present invention can be obtained from a study of the drawings, the disclosure and the appended claims.

We claim:

1. A current mirror circuit, comprising:

a first pnp transistor;

a second pnp transistor having a base connected to a base of the first pnp transistor forming a base junction;

a first npn transistor connected in series with the first pnp transistor, a collector of the first npn transistor connected to the base junction of the first and second pnp transistors;

a second npn transistor connected in series with the second pnp transistor, a base of the second npn transistor connected to a base of the first npn transistor forming a base junction, a collector of the second pnp transistor connected to the base junction of the first and second npn transistors;

a first resistor connected between an emitter of the first npn transistor and ground;

a second resistor connected between an emitter of the second npn transistor and ground;

a biasing resistor having a first side connected to the base junction of the first and second pnp transistors and a second side connected to ground;

a sense resistor coupled between a voltage source and an emitter of the first pnp transistor; and a third resistor coupled between the voltage source and an emitter of the second pnp transistor.

2. A current mirror circuit, comprising:

a sense resistor having a first side connected to an electrical energy source;

a first pnp transistor having an emitter connected to a second side of the sense resistor;

a first resistor having a first side connected to the electrical energy source;

a second pnp transistor having an emitter connected to a second side of the first resistor, a base of the second pnp transistor connected to a base of the first pnp transistor forming a base junction;

a first npn transistor connected in series with the first pnp transistor, a collector of the first npn transistor connected to the base junction of the first and second pnp transistors;

a second npn transistor connected in series with the second pnp transistor, a base of the second npn transistor connected to a base of the first npn transistor forming a base junction, a collector of the second pnp transistor connected to the base junction of the first and second npn transistors;

a second resistor connected between an emitter of the first npn transistor and ground; and a third resistor connected between an emitter of the second npn transistor and ground.

3. The current mirror circuit, as set forth in claim 2, further comprising a biasing resistor connected between the base junction of the first and second pnp transistors and ground.

4. The current mirror circuit, as set forth in claim 3, wherein a resistance value of the second resistor is approximately the same as a resistance value of the third resistor.

* * * * *